United States Patent [19]

Pansini

[11] 4,129,904

[45] Dec. 19, 1978

[54] SWIMMING POOL CLEANER

[76] Inventor: Andrew L. Pansini, 200 Golden Gate Ave., Belvedere, Calif. 94920

[21] Appl. No.: 851,441

[22] Filed: Nov. 14, 1977

[51] Int. Cl.[2] ..... B08B 3/02; B08B 9/08

[52] U.S. Cl. ..... 4/172; 4/172.15; 15/1.7; 134/167 R

[58] Field of Search ..... 4/172, 1, 172.15–172.18; 134/166 R, 167 R, 168 R; 15/1.7; 273/129 C; 46/91, 220; 114/220, 222

[56] References Cited

U.S. PATENT DOCUMENTS

| | | | |
|---|---|---|---|
| 3,108,298 | 10/1963 | Gelinas | 134/167 R X |
| 3,665,942 | 5/1972 | Moore | 134/167 R |
| 3,883,366 | 5/1975 | Blumenfeld | 134/167 R X |
| 3,918,148 | 2/1973 | Gibellina | 134/167 R |
| 3,921,654 | 11/1975 | Pansini | 134/167 R |
| 4,023,581 | 5/1977 | Pansini et al. | 15/1.7 X |

*Primary Examiner*—Stuart S. Levy

[57] ABSTRACT

An automatic swimming pool cleaner has a submergible transporter comprising a three piece assemblage having a rotatable intermediate fender wheel to engage the pool side walls and having generally pie-shaped fender members disposed above and below the fender wheel. The outer fender members are provided with pool bottom engaging wheels and with stabilizer fins and are connected to a water supply hose by a swivel connection.

8 Claims, 3 Drawing Figures

SWIMMING POOL CLEANER

BACKGROUND OF THE INVENTION

The subject pool cleaner is of the type which travels throughout the body of pool water, being normally submerged in operation, and which does not necessarily comprise one or more pendent whipping hoses, but instead produces a dirt removal action on the pool walls and surfaces by means of the dirt dislodging effect of a plurality of water supply hose jets and the dirt dislodging effect of the supply hose being moved while it is in contact with the pool wall surfaces. An effective cleaner of this type is shown in my U.S. Pat. No. 3,921,654. Such a cleaner is capable of doing an effective cleaning job on pool steps. Such a cleaner operates best in a free-form pool and has a tendency to become trapped and stalled in the corners of a rectangular pool or by pool ladders. The pool cleaner of the present invention is able to operate without becoming trapped in the corners of rectangular pools or by pool wall protuberances such as steps and ladders.

The best prior art of which I am aware consists of my above-mentioned U.S. Pat. No. 3,921,654 and my U.S. Pat. No. 3,392,738.

SUMMARY OF THE INVENTION

An object of the invention is to provide a submergible cleaner of the type described above which will not become trapped in rectangular pools or by pool wall protuberances in pools of any shape.

A further object of the invention is to provide such a cleaner with a symmetrically formed transporter which appears and operates the same whether it is right side up or upside down.

These and other objects and advantages of the invention will be apparent from the following description taken in conjunction with the drawing forming part of this specification, and in which.

DESCRIPTION OF THE INVENTION

Figure 1:
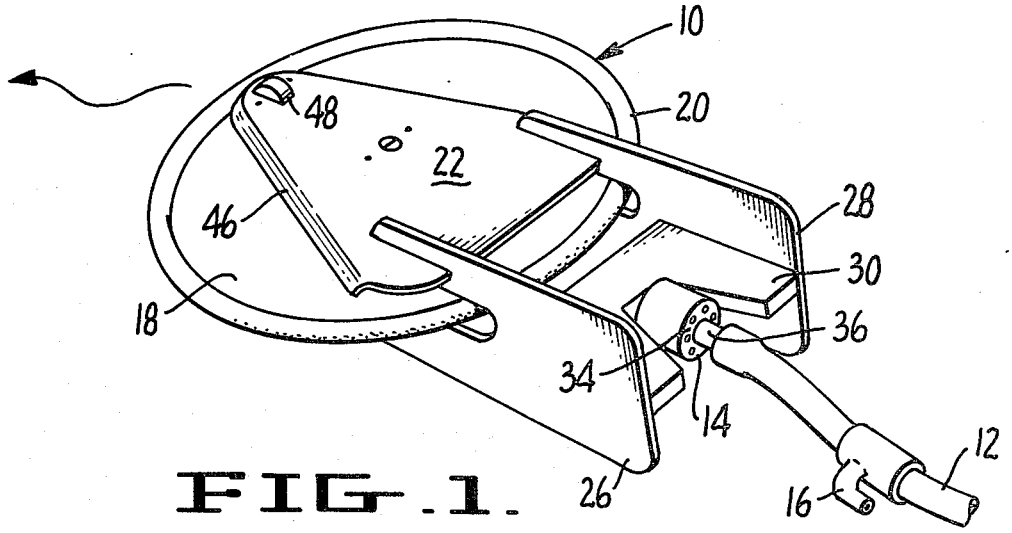
FIG. 1 is a view in perspective of the transporter portion of the subject cleaner.

The subject cleaner comprises a transporter (sometimes referred to as a carrier or a cleaner head) 10 and a water supply hose 12. The hose 12 is connected to a jet drive unit 14 of transporter 10 and hose 12 is provided with a plurality of jet drive units 16 (only one of which is shown) located at spaced intervals along the hose, each such jet 16 serving to push the supply hose segment immediately downsteam therefrom and pull the supply hose segment immediately upstream therefrom. The hose 12 is also preferably provided with the timer device, not shown, designated by reference No. 16 in my U.S. Pat. No. 4,007,749. The purpose and function of such timer device is to periodically shut off the supply of water to the water supply hose jets and the transporter drive jet, thereby "turning off" the cleaner for a predetermined abbreviated period of time, following which the timer device passes the supply water to the supply hose jets and transporter drive jet. During the period when the cleaner is turned off, the transporter floats either upwardly or downwardly (preferably upwardly) in the pool to escape from a trapped position. Since the subject cleaner embodies means to prevent such entrapment, repositioning of the transporter through periodic turning on and turning off of the supply water is utilized to increase the number of random paths which the transporter follows in traveling throughout the pool water.

The transporter 10 comprises a rotatable fender wheel 18 having a peripheral wear ring 20, a pair of pie-shaped fixed wheel corner and wheel fender members 22 and 24, a pair of stabilizer fins 26 and 28 attached to both members 22 and 24, and a web or plate member 30 interconnecting the two fins 26 and 28. The transporter drive jet unit 14 is attached directly to member 30. The jet unit 14 embodies swivel means 32 and 34 rendering the transporter rotatable about the longitudinal axis of the supply hose bib 36 which is carried by unit 14. Members 20, 22 and 24 are provided with hub elements 38, 40 and 42 which are held together by bolt 44. The wheel 18 is however freely rotatable between the two fender members 22 and 24.

The members 22 and 24 are provided with bevelled or slanted edges 46 and with freely rotatable roller elements 48. The rollers 48 serve as anti-friction bumper elements as the transporter engages the pool wall surfaces.

The transporter has a positive bouyancy so that when the supply water is turned off it rises to the surface of the pool. The web or plate 30 is provided with a controlled density which is slightly less than that of the balance of the transporter. Thus, when the supply water is turned on the transporter is biased to follow a slightly downwardly inclined path of travel in the pool.

During the course of the travel of the transporter within the pool water over a period of time, one or the other of the roller elements 48 comes into glancing contact with all portions of the pool side and bottom walls.

Figure 2:
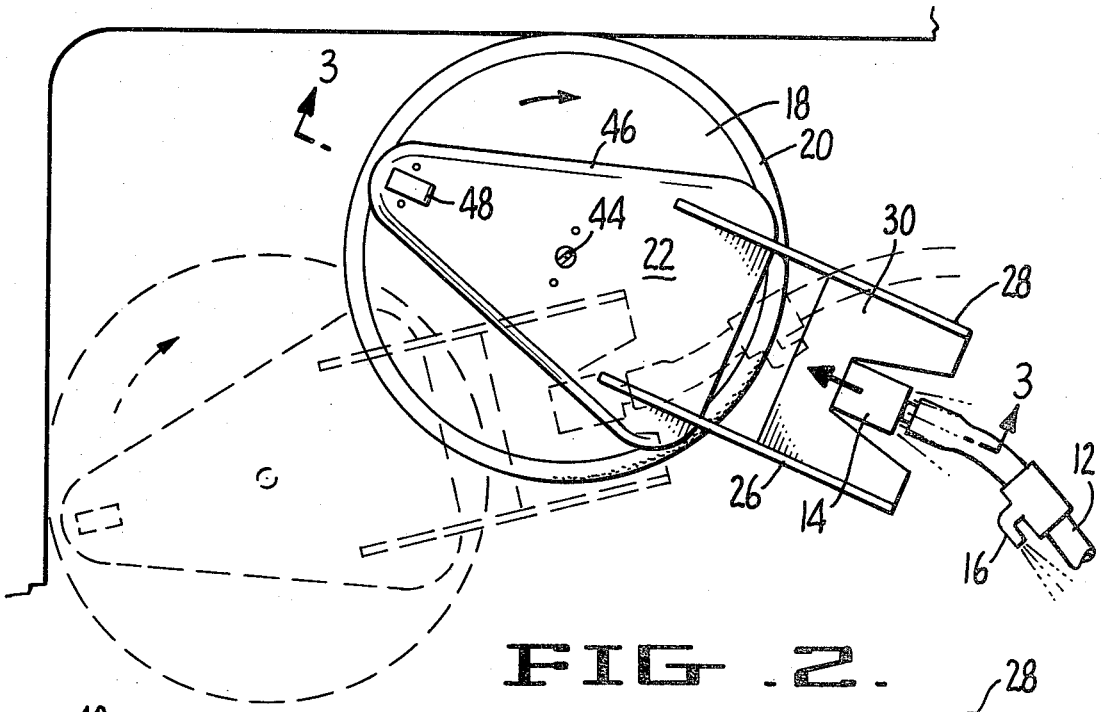
FIG. 2 is a top plan view which illustrates in sequential solid and dotted lines the manner of travel of the transporter through a corner zone of a rectangular pool.
Figure 3:
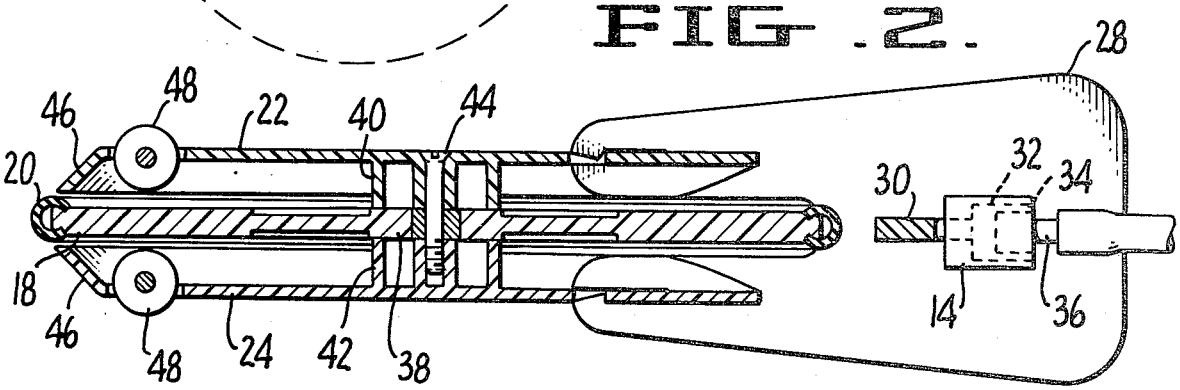
FIG. 3 is an enlarged view in section taken along lines 3—3 of FIG. 2.

FIG. 2 illustrates the manner in which the transporter avoids being trapped in a corner of the pool. It will be appreciated that the transporter tends to follow a line of travel which coincides with the longitudinal center line of the upper and lower pie-shaped fender members 22 and 24. When the wheel 18 engages a pool side wall the action of the jets 16 along with the readily flexible or bendable supply hose 12 causes the narrow ends of the members 22 and 24 to continually change direction as a pool corner is being traversed, the wheel 18 in effect rolling along the pool side wall surfaces defining the pool corner and preventing the leading narrow ends of members 22 and 24 from becoming pointed into the apex of the corner and thereby becoming trapped.

The fender members 22 and 24 serve several purposes and functions. They serve as a means for the cantilever support of the roller elements 48 and the rear sub-assembly comprising fins 26 and 28, web 30 and jet drive unit 14. While the members 22 and 24 are preferably pie-shaped in form, such description is intended to include such equivalents as tee-shaped members whereby, for example, the roller elements 48 are carried at the foot of the vertical of the tee and the fin assemblage is carried by the cross member part of the tee. By actually filling out such a skeletal tee to obtain the preferred pie-shaped form for the members 22 and 24, added fender protection is provided for centeral wheel member 18 and a directional and guidance function for the overall transporter is provided by the pie-shaped form of members 22 and 24. The two fender members 22 and 24 taken together with the fin assemblage may be considered to be a streamlined carrier vessel for the anti-entrapment wheel 18. The wheel is located along the plane of symmetry of the transporter. Since the transporter is symmetrical with reference to the wheel 18, it looks and operates the same when right side up as it does as when it is upside down. The fins 26 and 28 prevent the transporter from running in circles which would cause twisting and knotting of the supply hose.

By providing cantilever support means for guide wheel means 48 and guidance means 26 and 28 above as well as below the wheel 18, not only is the described symmetry made possible, with the attendant result that the operator need not be concerned with the orientation attitude of the transporter, but it is also thereby made possible to locate the jet drive unit 14 out of immediate proximity to the closest possible pool wall surface. This tends to prevent a slowing down or stalling of the transporter which has been found to occur when the drive jet unit 14 is more closely disposable adjacent a pool wall surface.

What is claimed is:

1. In a swimming pool cleaner, a carrier and means associated therewith operable to drive said carrier in a submerged condition above the bottom of a pool, said carrier comprising a wheel member, a wheel carrier and wheel fender member disposed in closely adjacent and overlying relation to said wheel member inwardly of the periphery thereof, said carrier and fender member having a leading end and a trailing end, said wheel member being attached to said carrier and fender member for substantially free rotational movement relative thereto, a guidance roller element carried at the leading end of said carrier and fender member, and guidance fin means attached to the trailing end of said carrier and fender member.

2. In a swimming pool cleaner, the carrier of claim 1, said carrier and fender member being generally pie-shaped, being narrow at its leading end and wide at its trailing end.

3. In a swimming pool cleaner, the carrier of claim 1 further comprising a second alike wheel carrier and wheel fender member disposed in closely adjacent and underlying relation to said wheel member inwardly of the periphery thereof, said second member having a leading end and a trailing end, said wheel member being also attached to said second member for substantially free rotational movement relative thereto, and a guidance roller carried at the leading end of said second member, said guidance fin means being also attached to the trailing end of said second member.

4. In a swimming pool cleaner, the carrier of claim 3, said carrier and fender members being generally pie-shaped, being narrow at their leading ends and wide at their trailing ends.

5. In a swimming pool cleaner, the carrier of claim 3, said guidance fin means comprising a pair of spaced, vertically disposed fin members which extend from above said first-mentioned carrier and fender member to below said second member, and a horizontally disposed stabilizer member interconnecting said fin members and disposed substantially in the plane of said wheel member.

6. In a swimming pool cleaner, the carrier of claim 5, said first-mentioned means including a jet drive unit mounted on and directed rearwardly from said horizonatally disposed stabilizer member.

7. In combination, the carrier of claim 6, and a flexible water supply hose connected in delivery relation to said jet unit, said hose having at spaced intervals jet drive units each operable to pull the adjacent upstream portion of the supply hose and to push the adjacent downstream portion of the supply hose.

8. The combination of claim 7 further including a swivel connection between the carrier and supply hose whereby the carrier is free to rotate about the longitudinal axis of the downstream end of the supply hose to which the carrier is connected.

* * * * *